United States Patent [19]

Rondel et al.

[11] Patent Number: 4,878,701

[45] Date of Patent: Nov. 7, 1989

[54] PORTABLE DOOR LOCK

[75] Inventors: Stephen A. Rondel, Redmond; James B. Dobson, Seattle, both of Wash.

[73] Assignee: Advanced Products & Technologies, Redmond, Wash.

[21] Appl. No.: 39,539

[22] Filed: Apr. 16, 1987

[51] Int. Cl.[4] ..... E05C 19/18

[52] U.S. Cl. ..... 292/288; 292/292; 292/295

[58] Field of Search ..... 70/14; 292/271, 289, 292/290, 291, 292, 293, 294, 295, 296, 298

[56] References Cited

U.S. PATENT DOCUMENTS

| | | | |
|---|---|---|---|
| 583,108 | 5/1897 | Batchelder | 292/293 |
| 663,036 | 12/1900 | Mitchell | 292/292 |
| 902,772 | 11/1908 | Stoffel | 292/296 |
| 910,431 | 1/1909 | Stoffel | 292/296 |
| 939,785 | 11/1909 | Auger | 292/292 |
| 969,631 | 9/1910 | Johnson | 292/293 |
| 982,017 | 1/1911 | Packard | 292/296 |
| 1,065,396 | 6/1913 | Rose | 292/295 |
| 1,147,459 | 7/1915 | Stoddard | 292/296 |
| 1,282,989 | 10/1918 | Tuller | 292/296 |
| 1,308,473 | 7/1919 | Boehringer et al. | 292/295 |
| 1,544,480 | 6/1925 | Racine | 292/293 |
| 1,947,773 | 2/1934 | Haviland | 292/292 |
| 1,977,430 | 10/1934 | Dalton | 292/296 |
| 2,737,043 | 3/1956 | Blohm | 70/14 |
| 2,969,253 | 1/1961 | Schettl | 292/294 |
| 3,416,333 | 12/1968 | Weingart | 70/14 |
| 3,423,968 | 1/1969 | Foote | 70/14 |
| 3,429,151 | 2/1969 | Weingart | 70/14 |
| 3,451,235 | 6/1969 | Weingart | 70/14 |
| 3,475,929 | 11/1969 | Weingart | 70/14 |
| 3,563,593 | 2/1971 | Leier | 292/296 |
| 3,596,961 | 8/1971 | Lippman | 292/292 |
| 4,072,333 | 2/1978 | Hutter, III | 292/292 |
| 4,169,619 | 10/1979 | McCracken | 292/290 |
| 4,285,535 | 8/1981 | Leary | 292/293 |

FOREIGN PATENT DOCUMENTS

| | | | |
|---|---|---|---|
| 2507770 | 9/1976 | Fed. Rep. of Germany | 70/14 |
| 766773 | 4/1934 | France | 292/296 |

*Primary Examiner*—Gary L. Smith
*Assistant Examiner*—Eric K. Nicholson
*Attorney, Agent, or Firm*—Graybeal, Jensen & Puntigam

[57] ABSTRACT

A portable door lock for securing a door from the interior. The lock includes a retractable blade (10) for interaction with the door strike plate and a handle (12) including mechanism to prevent motion of the blade when the handle is not coliner with the blade.

2 Claims, 4 Drawing Sheets

PORTABLE DOOR LOCK

TECHNICAL FIELD

This invention relates to a portable door lock and more particularly to a lock which may be quickly and easily used to secure a door from the interior. The lock includes a blade for interacting with the latch plate secured to the door jamb and a handle for abutting the interior of the door and when moved to a position out of alignment with the blade causes the internal mechanism to secure the blade from movement with respect to the handle preventing the door from being opened.

BACKGROUND ART

This invention relates to portable door securing devices which may be temporarily installed on the inside of an inwardly swinging entrance door preventing unauthorized entry into the room or building. More particularly, the invention relates to an improved portable door lock the type wherein the lock is installed to extend between the door and associated frame with the first portion of the lock being engaged with the frame mounted strike plate and a second portion of the lock being moved into abutment and secured against the surface of the door preventing inward movement thereof, which can be attached and removed in one step.

The need for and desirability of portable door locks being utilized by occupants of a building or room for securing the entrance has long been recognized. Such locks are for example advantageous as a supplemental lock for hotel or motel rooms since the occupants of these premises have no control over access to keys and/or security chains can be easily broken. Further, although various permanently mounted auxiliary locks are sometimes provided, such devices do not necessarily provide the desired degree of protection and are not always maintained in a proper operating condition and statistics indicate that past employees are often involved in motel/hotel break-ins.

A variety of supplemental locking devices that are easily stored and/or carried in a suitcase, purse or other container have been taught in the prior art. Such prior art devices include auxiliary locking arrangements which include a relatively thin locking bar or extension to be placed between the door and the frame and interact with the strike plate preventing movement of the bar in the direction of the door opening. A blocking member is then generally moved along or interacts with the locking bar and is secured in abutment with the inner surface of the door.

Prior art devices which deal with the above noted problem include U.S. Pat. No. 633,078 granted to Crane on Sept. 12, 1899 and discloses a locking bar for placement between the door and the frame interacting with the strike plate, and a transversely positionable wedge member which is then secured against the door and frame preventing relative movement therebetween.

U.S. Pat. No. 1,544,480 granted to Racine on June 30, 1925 discloses a locking bar for interaction with the strike plate and a sliding ratchet type device used in conjunction with an inclined plane to secure a device against the door preventing inward movement thereof.

U.S. Pat. No. 2,969,253 granted to Schettel on June 24, 1961 discloses a blade for interacting with the strike plate and a piece of resilient material which is forced into abutment against the door and secured to place by a device which in normal position prevents inward movement of the door by interacting with saw teeth on the blade but is quickly released by moving the securement device out of alignment.

U.S. Pat. No. 3,416,333 granted to Weingart Dec. 17, 1968 discloses a travel lock having a blade to interact with the strike plate having opposing serrated edges which interact with a second plate abutting the door and the frame at right angles to the blade.

U.S. Pat. No. 3,429,151 granted to Weingart Feb. 25, 1969 discloses essentially an identical device to the lock patent granted in '68 however it includes a threaded member to interact with the blade allowing more precise adjustment.

U.S. Pat. No. 3,423,968 granted to Foote Jan. 28, 1969 discloses a blade having opposing serrated edges and a key lock device for interacting with those edges preventing movement of the door.

U.S. Pat. No. 3,451,235 granted to Weingart on June 24, 1969 discloses yet another variation of a door lock whereas opposed to edge serrations he includes notches at approximately the center of the blade interacting with a perpendicular slide plate.

U.S. Pat. No. 3,476,929 granted Nov. 4, 1969 to Weingart discloses a locking device similar to that of the '235 patent only adapted for use on drawers as well as doors.

U.S. Pat. No. 3,596,961 granted to Lippman Aug. 3, 1971 discloses a door locking device including a blade for interacting with the strike plate and including opposing serrated edges interacting with a spring biased abutment plate which latches on the serrations.

U.S. Pat. No. 4,285,535 granted to Leary on Aug. 25, 1981 discloses a blade for interacting with the latch plate and a door abutting device which is secured in position by the interaction of a threaded rod extending from the blade interacting with a latch mechanism and congruent threads for adjusting the door abutting means.

DISCLOSURE OF THE INVENTION

With the above noted prior art in mind, it is an object of the present invention to provide lightweight, simple, easy to use portable door locking mechanism.

It is another object of the present invention to provide a door locking mechanism which is simple to apply and equally as simple to remove.

Still another object of the present invention is to provide a portable door locking mechanism which requires virtually no manipulation to place in position or to remove.

Still a further object of the present invention is to provide a mechanism whereby a change in angularity between the handle and the blade of a door locking mechanism causes the relative position of the blade and the handle to be locked.

Still a further object of the present invention is to provide an internal mechanism which causes a locking device to be moved into position as a result of a slight change in angularity of the relative parts.

Still a further object of the present invention is to provide a mechanism whereby two normally interlocking and interferring mechanisms are selectively held in a separated condition for relative movement therebetween.

BEST MODE FOR CARRYING OUT THE INVENTION

Figure 1:
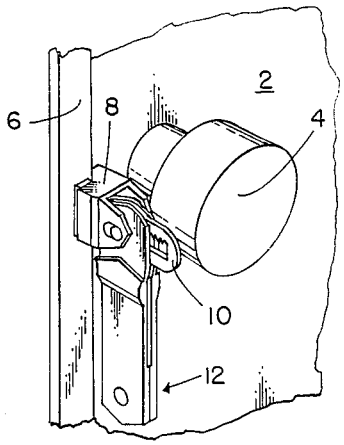
FIG. 1 is an isometric view of the inventive door lock in position.

As seen in FIG. 1, the door 2 having a standard handle or knob is closed to meet the frame 6. The present invention including a snubbing portion of the handle 8 blade 10 and the handle itself 12 are shown in latched position.

Figure 2:
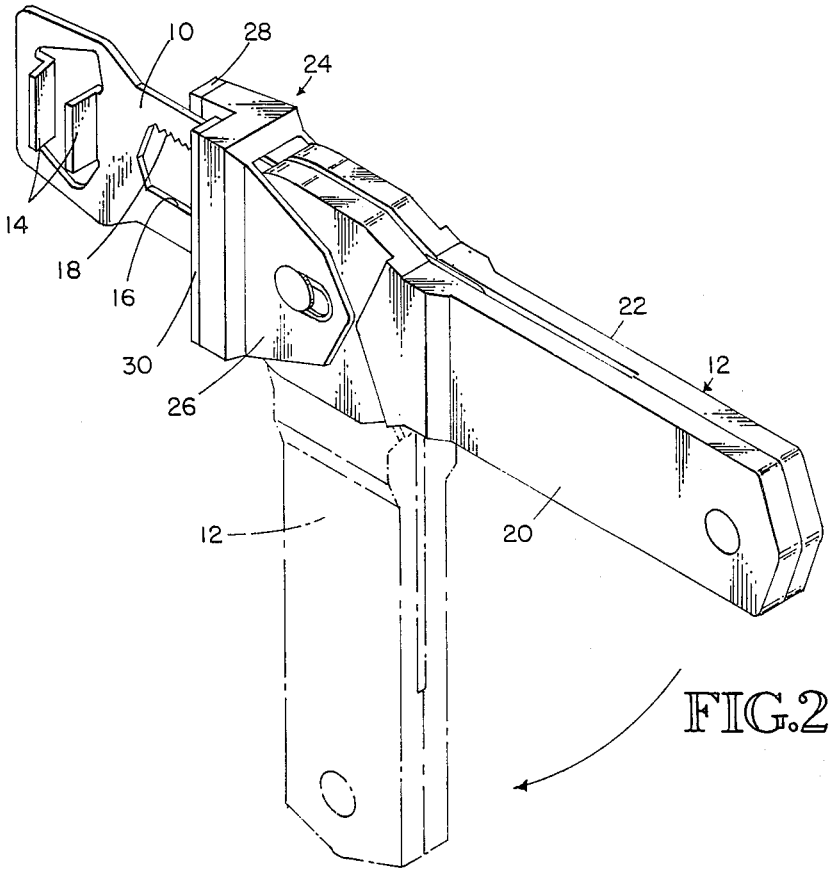
FIG. 2 is an isometric view of the door lock itself with the locked position shown in phantom.

Referring now to FIG. 2, the device of FIG. 1 can be seen in greater detail and can be seen that the blade 10 includes at its exterior end a pair of outwardly projecting tabs 14 which interact with the strike plate mounted to the door jamb and an interior slot 16 including one serrated edge 18 to interact with the locking mechanism described in greater detail hereinafter. The handle 12 includes a pair of identical half-members 20, 22 secured at opposite ends and including at its forward end, as described hereinafter, the operating mechanism. Also at the forward end of the handle is a pivotally mounted pressure block 24 having rearwardly extending ears 26 overlapping and pivotally mounted to the front end of the main handle portion 12 and having door and frame abutting pads 28, 30. As seen in this view when the lock is to be secured in position handle 12 is moved to a position at an angle to the blade 10.

Figure 3:
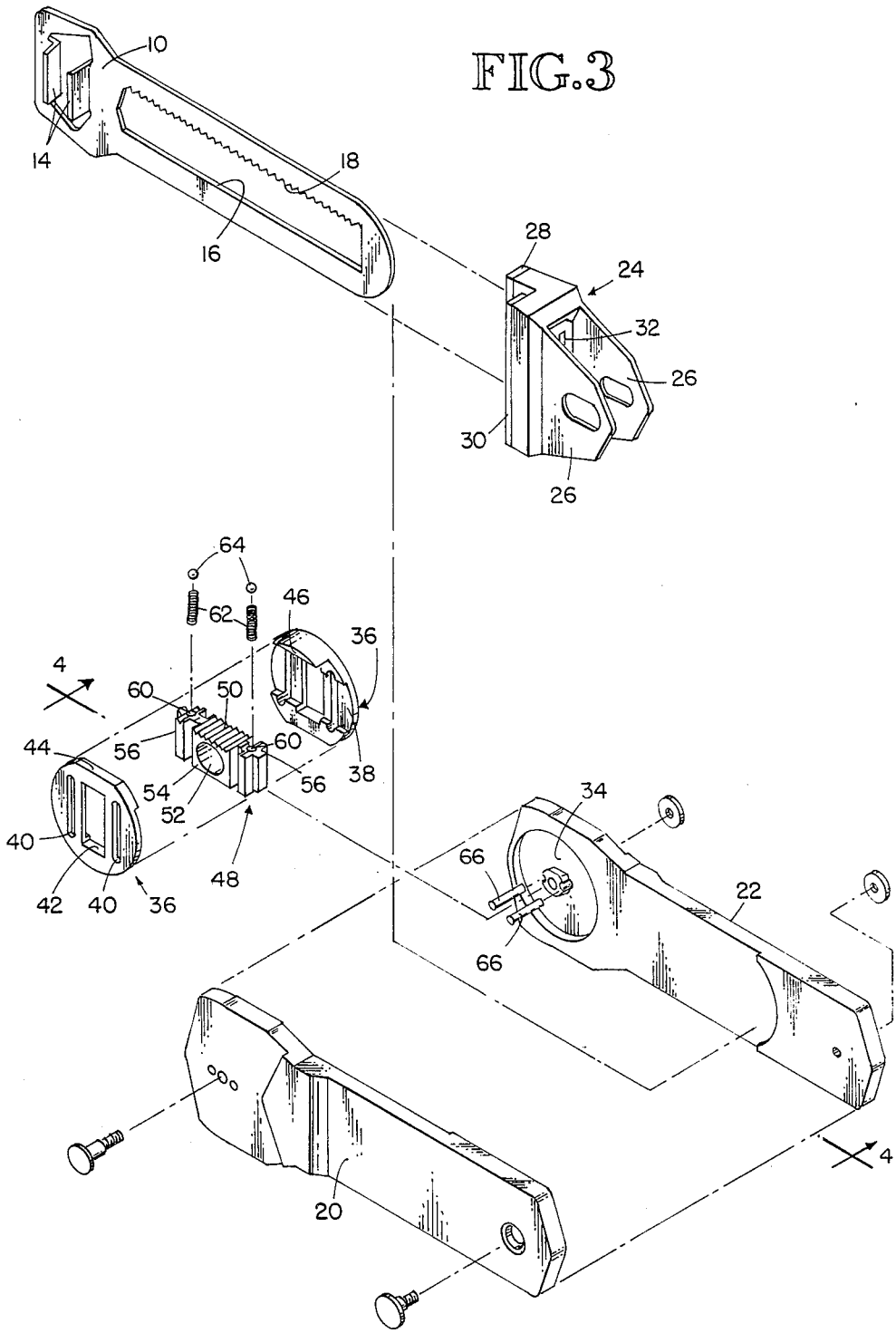
FIG. 3 is an exploded view of the inventive portable door lock.

Reference is now made to FIG. 3 wherein the blade and handle mechanism are shown in exploded condition thereby disclosing the operating mechanism which is mounted in the forward portion of and between the two handle halves 20, 22. As seen in this view, the pressure block 24 includes a slot 32 to receive the back portion of blade 10. Mounted within the hollowed out circular portion 34 of handle halves 20, 22 in interacting relationships with blade 10 are carriage halves 36 including inwardly facing grooves 38 and a pair of transverse parallel slots 40 which are separated by a wider parallel slot 22. Carriage halves 36 likewise include a portion where a segment has been removed leaving a flat surface 44 perpendicular to the slots 40 interacting with an outwardly projecting tab 46 on the opposite member. When the two halves are placed in face to face condition, they are rotationally locked and capture the blade and operating mechanism.

Mounted between the carriage halves 36 is a dog 48 configured with a serrated edge 50 for selective interaction with serrated edge 18 of blade 10, an off-center bore 52 and having sides configured such that the dog 48 is guided for movement by the carriage halves having the main body portion 54 move within slot 42 and the end portions 56 move within slots 40. A pair of bores 60 containing springs 62 porting balls 64 extend into the dog from the serrated edge. The circumference of carriage halves 36 fit within the opposing bores 34 and a pair of diametrically opposed pins 62 located on the circle concentric to that of bore 34 extend through the entire assemblage secured in place by each of the handle halves.

Figure 4:
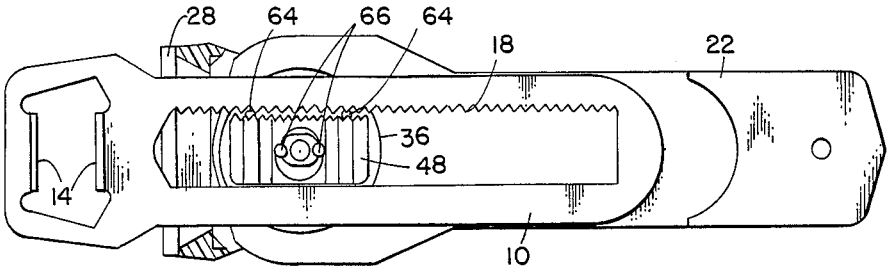
FIG. 4 is a sectional view taken along lines 4—4 of FIG. 3 showing the interrelationship of the interior elements of the present invention.
Figure 5:
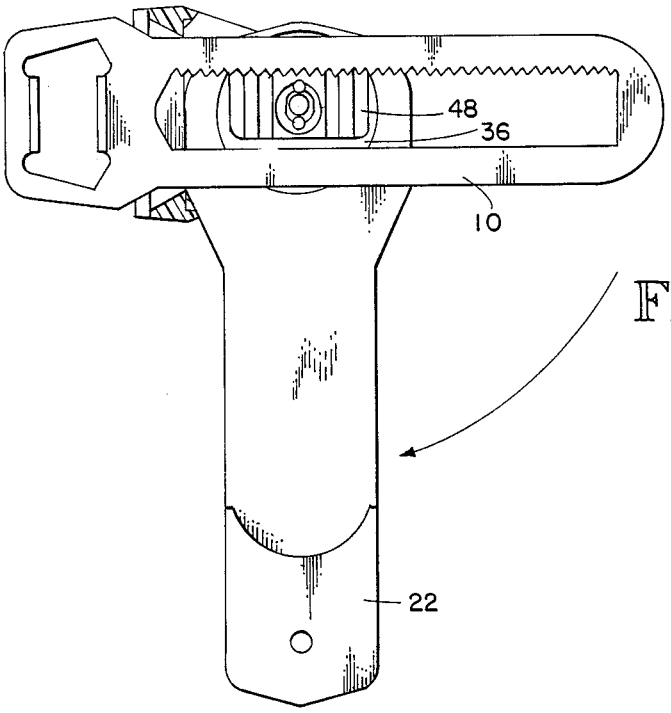
FIG. 5 is a view similar to that of FIG. 4 depicting the mechanism when the handle is moved angularly relative to the blade.

The bore 52 is located in the lower half of dog 48 such that when the handle member is moved angularly relative to the blade the blade causes the entire assembly to turn, moving the dog into and out of engagement with the serrations 18 on the plate 10. Thus as the appliance is being applied the handle is maintained in position as seen in FIG. 4 whereas movement to the position as seen in FIG. 5 causes the dog to interact with the blade preventing relative linear movement.

Figure 6:
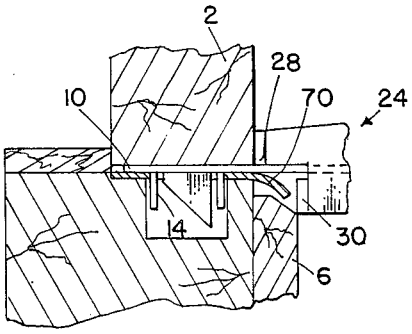
FIG. 6 is a horizontal sectional view showing the interaction between the blade, the handle and the door and frame.

As seen in FIG. 6, the tabs 14 on blade 10 interact with the strike plate 70 secured to the doorjamb. The pressure block 24 prevents outward or open movement of the door 2.

Figure 7:
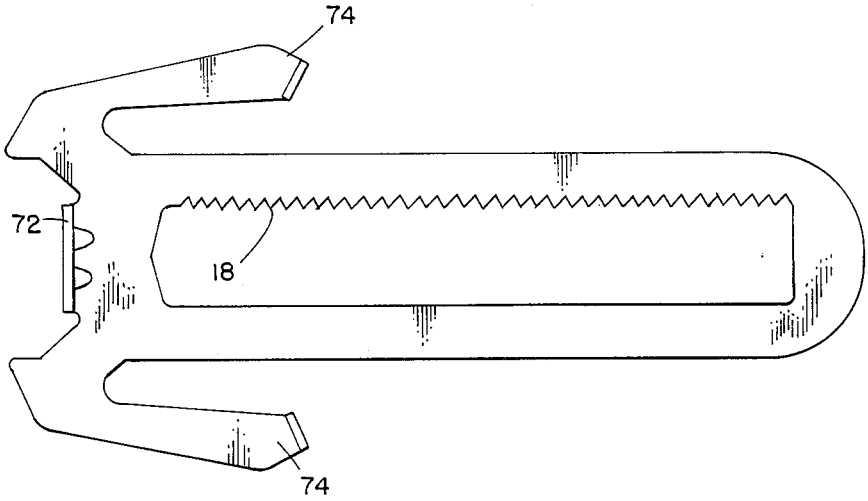
FIG. 7 is an alternate embodiment of the blade.
Figure 8:
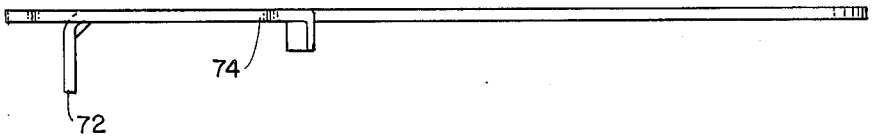
FIG. 8 is a vertical view of the blade of FIG. 7.

Reference is now had to FIGS. 7 and 8 which disclose an alternative embodiment of the blade wherein the single tab member 72 interacts with the strike plate and the rearwardly extending ears 74 interact with the door frame preventing angular movement therebetween.

Thus as can be seen the present invention comtemplates a single easy to use portable door lock which may be quickly applied, used and quickly removed.

I claim:

1. A portable device for securing doors or the like comprising:

a blade means including an outer end for fixedly engaging the latch plate of a doorjamb while allowing the door latch to function normally and an inner elongated end having a serrated edge along a substantial portion of its length, being selectively engaged by a retractable dog having a serrated edge, said dog being biased away from said inner elongated end by a spring biased roller means continuously urging the dog to a nonengaging position;

a handle means, rotatably connected to said dog, said handle means moveable along the blade means such that when the handle means and the blade means are parallel, the dog is freely moveable along the inner elongated end of the blade means and when the handle means is at an angle to the blade means the dog prevents relative movement between the handle means and the blade means; and a pressure block attached to said handle means, such that when said blade means engages the latch plate and when said pressure block abuts the door and is held in place by the action of the dog, it securely holds the door in a closed position.

2. A device as in claim 1, wherein the handle member includes means to force engagement between the dog and the serrations of the blade when the handle is moved to a position where it is not parallel to the arm.

* * * * *